US010522019B1

(12) United States Patent
Shuker

(10) Patent No.: US 10,522,019 B1
(45) Date of Patent: Dec. 31, 2019

(54) PORTABLE LIGHTHOUSE ASSEMBLY

(71) Applicant: Derek Shuker, Gainesville, TX (US)

(72) Inventor: Derek Shuker, Gainesville, TX (US)

( * ) Notice: Subject to any disclaimer, the term of this patent is extended or adjusted under 35 U.S.C. 154(b) by 0 days.

(21) Appl. No.: 16/288,288

(22) Filed: Feb. 28, 2019

(51) Int. Cl.

| | |
|---|---|
| ***G08B 15/00*** | (2006.01) |
| ***G08B 13/196*** | (2006.01) |
| ***G08B 13/16*** | (2006.01) |
| ***F21L 4/08*** | (2006.01) |
| ***F21V 23/04*** | (2006.01) |
| ***F21V 33/00*** | (2006.01) |
| ***F21V 14/02*** | (2006.01) |
| ***G08B 3/10*** | (2006.01) |

(52) U.S. Cl.
CPC ..... *G08B 15/00* (2013.01); *F21L 4/08* (2013.01); *F21V 14/025* (2013.01); *F21V 23/0478* (2013.01); *F21V 33/0076* (2013.01); *G08B 3/10* (2013.01); *G08B 13/1672* (2013.01); *G08B 13/19695* (2013.01)

(58) Field of Classification Search
CPC ..... G08B 15/00; G08B 3/10; G08B 13/1672; F21L 4/08; F21V 14/025; F21V 23/0478; F21V 33/0076
USPC ..... 340/541
See application file for complete search history.

(56) References Cited

U.S. PATENT DOCUMENTS 1,404,962 A * 1/1922 Hutchinson ..... B64F 1/20 340/956
3,696,380 A 10/1972 Murphy
4,261,687 A * 4/1981 Gerberick ..... F03D 3/067 40/473
4,446,454 A 5/1984 Pyle
5,317,305 A 5/1994 Campman
5,440,292 A * 8/1995 Bedrosian ..... G08B 13/193 340/531
5,850,180 A 12/1998 Hess
5,892,446 A * 4/1999 Reich ..... A01K 15/02 119/720
5,939,987 A * 8/1999 Cram ..... G08G 1/095 116/22 A
6,118,375 A * 9/2000 Duncan ..... G08B 13/193 340/522
6,147,609 A * 11/2000 Spies ..... A01K 1/0017 340/332
6,828,909 B2 12/2004 Script
7,278,375 B2 * 10/2007 Ross ..... A01K 15/02 116/22 A
7,462,364 B2 * 12/2008 Bell ..... A01M 29/10 424/405

(Continued)

*Primary Examiner* — Nay Tun

(57) ABSTRACT

A portable lighthouse assembly for deterring intruders includes a lighthouse having a height less than 4.0 feet. A light emitter is rotatably positioned in the lighthouse to emit light outwardly therefrom. The light house is positionable in a yard to deter intruders when the light emitter is turned on. A motion sensor is coupled to the lighthouse to sense motion within a pre-determined perimeter of the lighthouse. The light emitter is turned on when the motion sensor senses motion. An alarm is coupled to the lighthouse to emit an audible alarm when the motion sensor senses motion. A camera is coupled to the lighthouse to capture images or video of an environment of the lighthouse. A microphone is coupled to the lighthouse to record audible sounds proximate the lighthouse.

8 Claims, 6 Drawing Sheets

(56) References Cited

U.S. PATENT DOCUMENTS 7,603,959 B1 * 10/2009 Veazey ..... B63B 3/08 114/263
8,281,747 B1 * 10/2012 Few ..... A01K 15/023 119/719
8,410,941 B2 * 4/2013 Kelly ..... E01B 17/00 116/22 A
9,044,770 B1 * 6/2015 Eyring ..... B05B 12/122
9,204,622 B2 * 12/2015 Wong ..... A01K 15/023
9,460,596 B1 * 10/2016 Moses ..... H04N 7/14
9,743,013 B1 * 8/2017 Merrill ..... H04N 5/2252
9,861,092 B2 * 1/2018 Purpura ..... A01M 29/16
10,028,502 B2 * 7/2018 Nichols ..... A01M 29/24
10,192,418 B1 * 1/2019 Kern ..... G08B 15/02
10,264,781 B2 * 4/2019 Ryan ..... A01M 29/12
10,371,326 B2 * 8/2019 Grandadam ..... H05B 33/0845
10,392,829 B2 * 8/2019 Peter ..... H04M 1/72527
2002/0145519 A1 * 10/2002 Hykawy ..... G08G 1/164 340/567
2005/0185398 A1 * 8/2005 Scannell, Jr. ..... A01G 9/02 362/227
2005/0267605 A1 * 12/2005 Lee ..... G05B 15/02 700/19
2006/0147086 A1 * 7/2006 Stobbe ..... H04N 7/18 382/103
2009/0244279 A1 * 10/2009 Walsh ..... B60R 11/04 348/143
2010/0188850 A1 * 7/2010 Maxik ..... F21S 8/088 362/249.06
2011/0012734 A1 * 1/2011 Reese ..... G08B 13/19 340/541
2011/0085040 A1 * 4/2011 Joslyn ..... G08B 13/196 348/157
2013/0107041 A1 * 5/2013 Norem ..... H04N 5/225 348/143
2016/0027262 A1 * 1/2016 Skotty ..... G08B 13/19632 340/541
2017/0027157 A1 * 2/2017 Purpura ..... A01M 29/16
2018/0035084 A1 * 2/2018 Swiss ..... H04N 7/183
2018/0040209 A1 * 2/2018 Lim ..... G08B 5/22
2019/0063696 A1 * 2/2019 Grandadam ..... F21L 4/02

* cited by examiner

PORTABLE LIGHTHOUSE ASSEMBLY

(b) CROSS-REFERENCE TO RELATED APPLICATIONS

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to lighthouse devices and more particularly pertains to a new lighthouse device for deterring intruders.

(h) BRIEF SUMMARY OF THE INVENTION

An embodiment of the disclosure meets the needs presented above by generally comprising a lighthouse having a height less than 4.0 feet. A light emitter is rotatably positioned in the lighthouse to emit light outwardly therefrom. The light house is positionable in a yard to deter intruders when the light emitter is turned on. A motion sensor is coupled to the lighthouse to sense motion within a predetermined perimeter of the lighthouse. The light emitter is turned on when the motion sensor senses motion. An alarm is coupled to the lighthouse to emit an audible alarm when the motion sensor senses motion. A camera is coupled to the lighthouse to capture images or video of an environment of the lighthouse. A microphone is coupled to the lighthouse to record audible sounds proximate the lighthouse.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
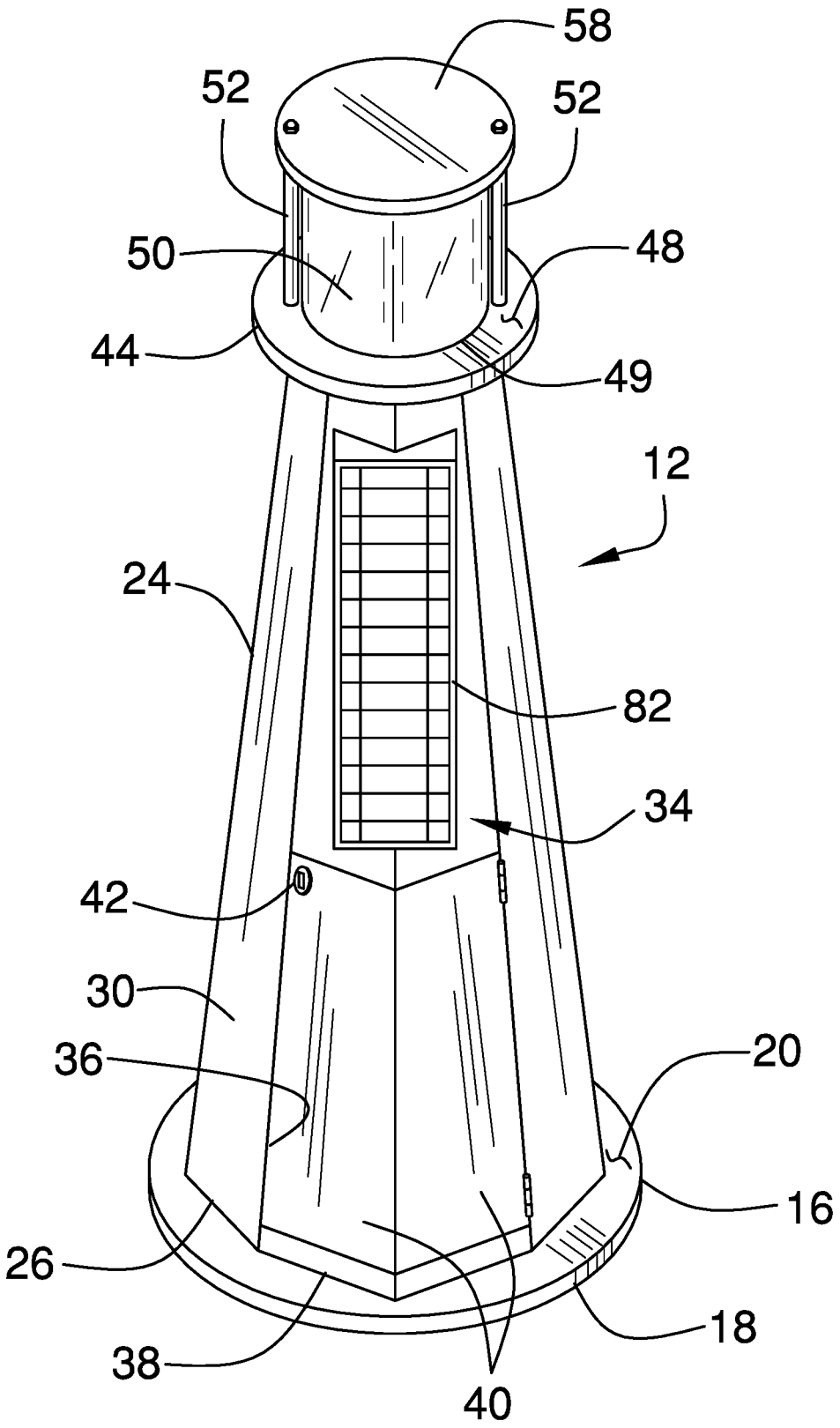
FIG. 1 is a back perspective view of a portable lighthouse assembly according to an embodiment of the disclosure.
Figure 2:
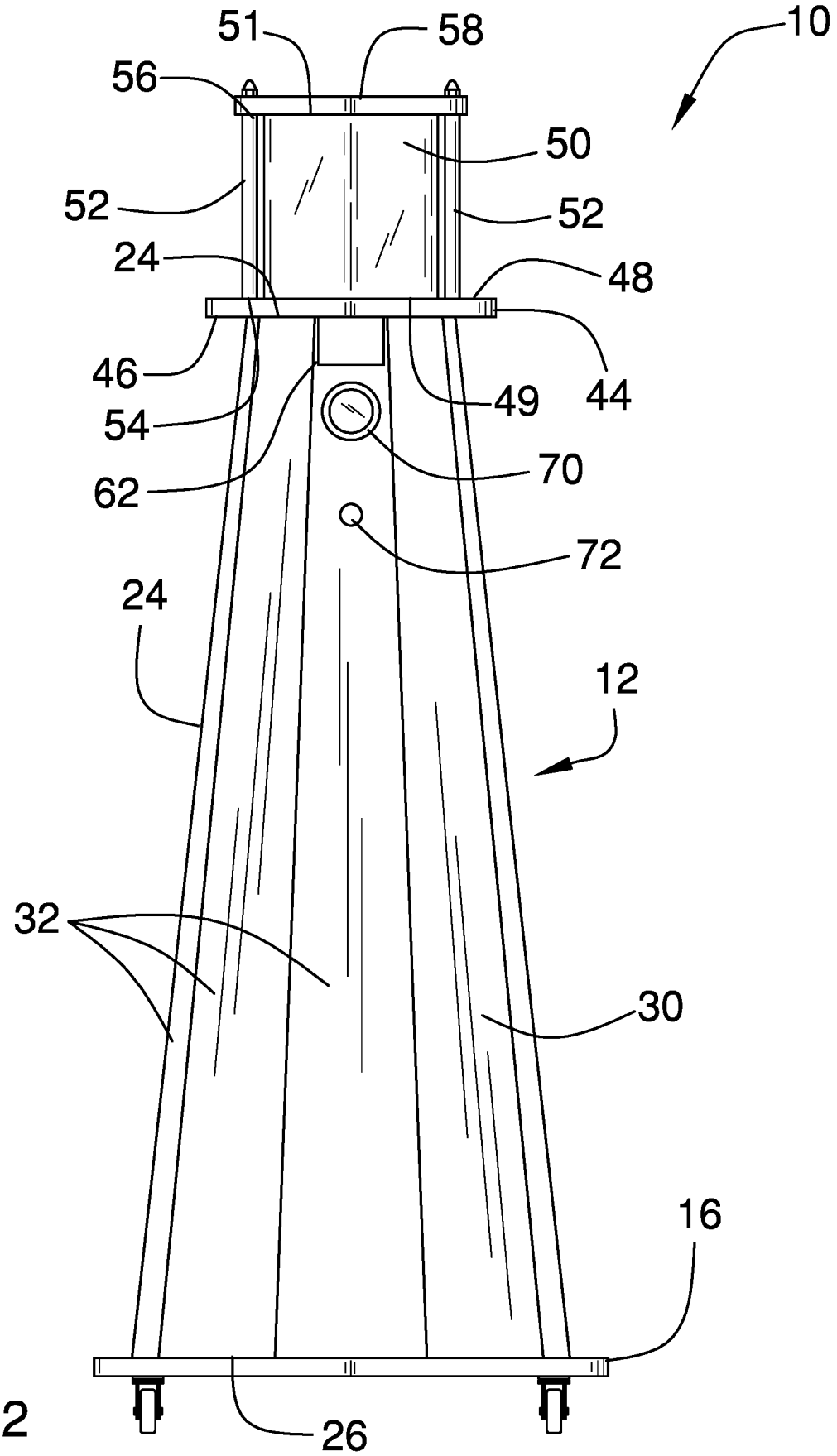
FIG. 2 is a front view of an embodiment of the disclosure.
Figure 3:
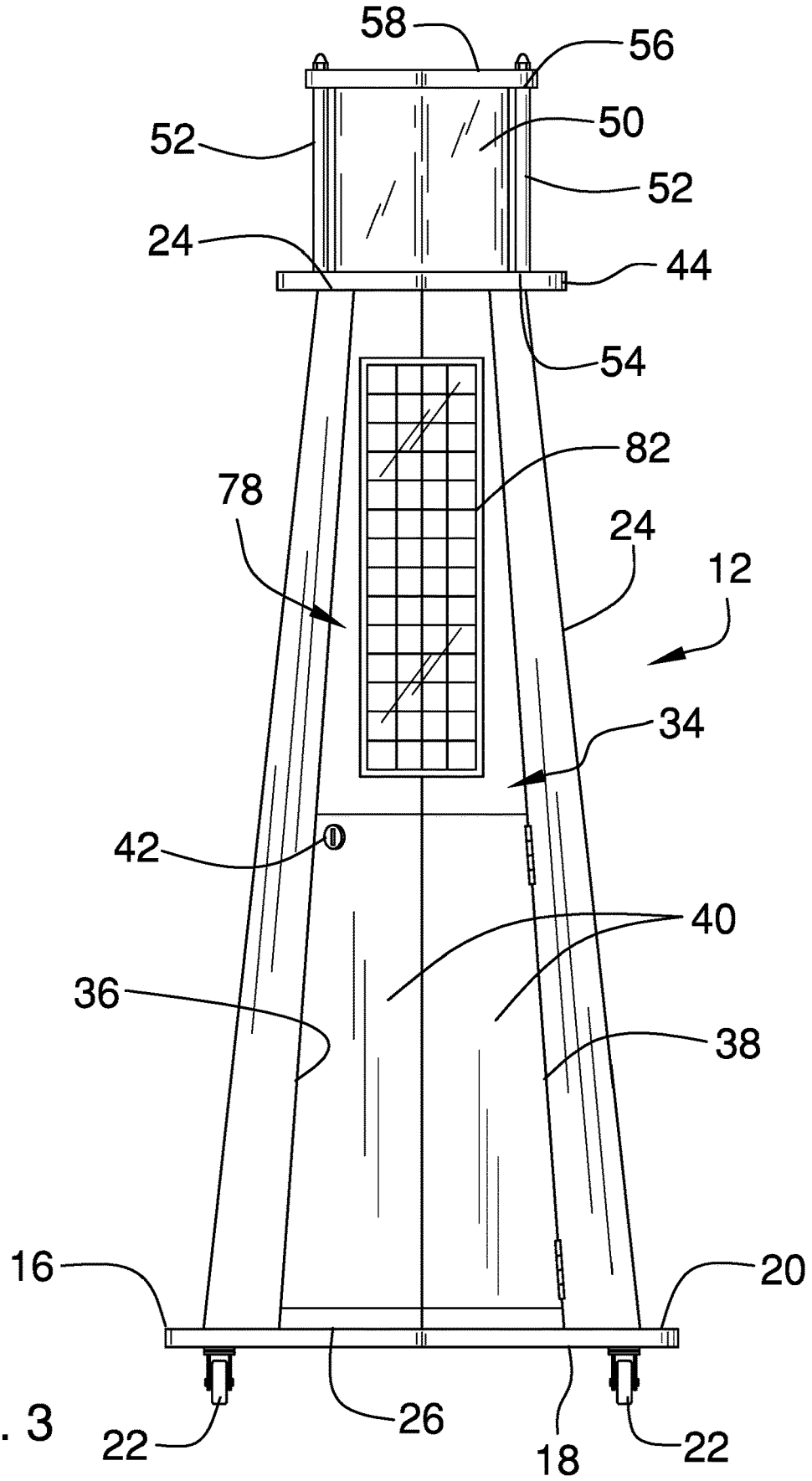
FIG. 3 is a back view of an embodiment of the disclosure.
Figure 4:
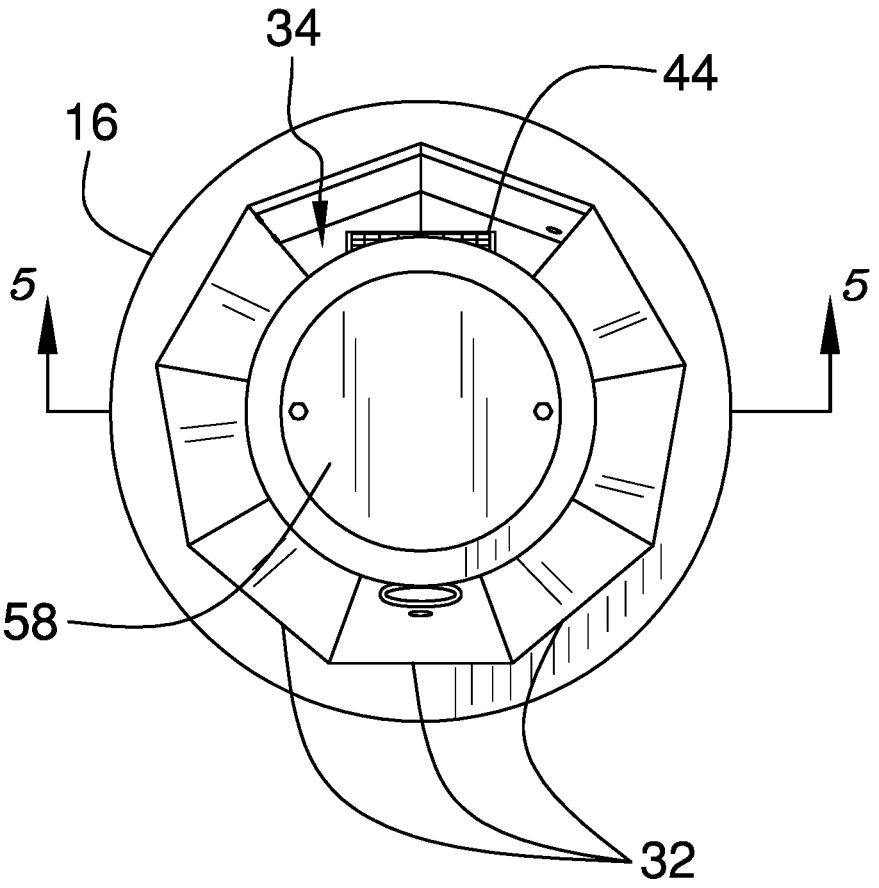
FIG. 4 is a top view of an embodiment of the disclosure.
Figure 5:
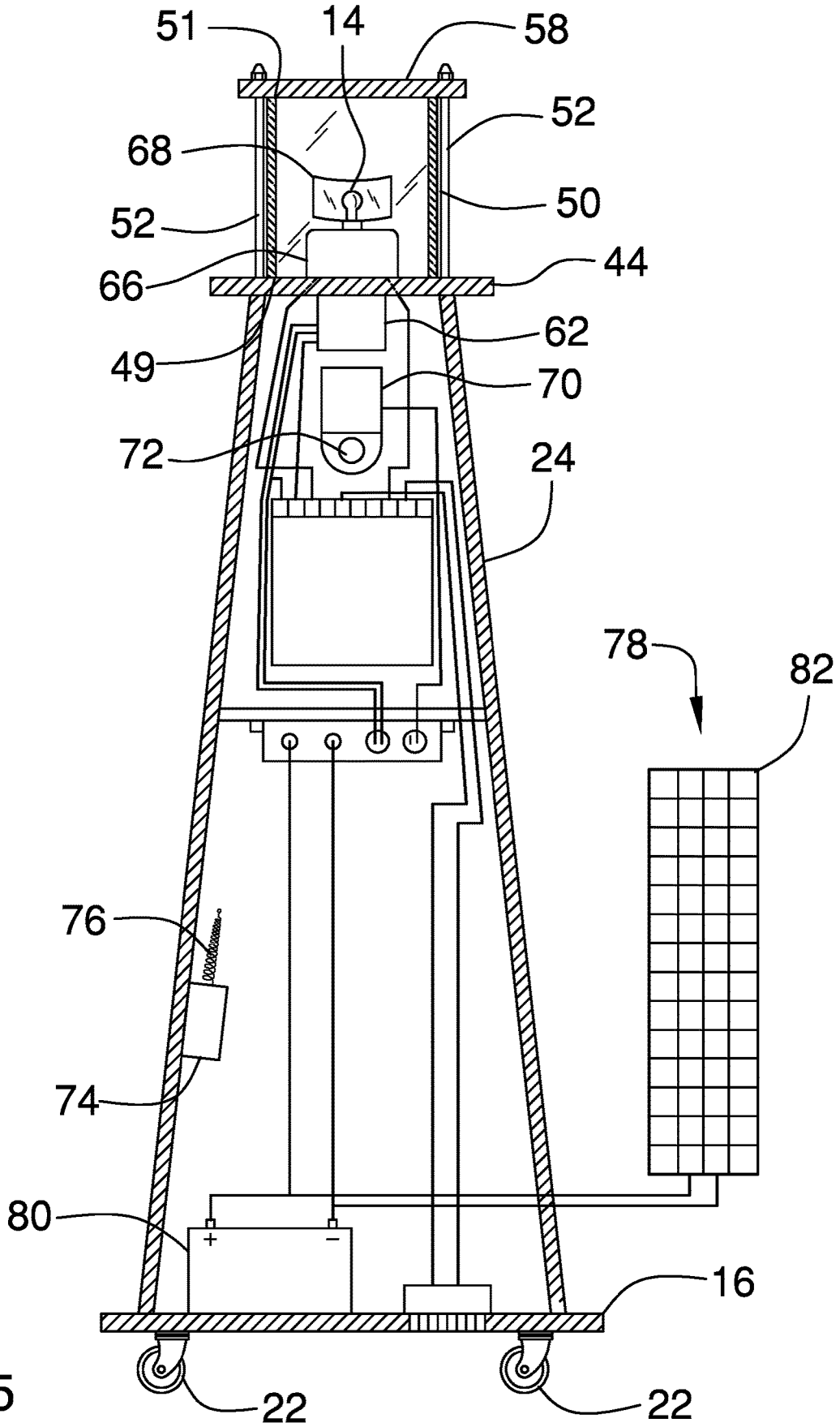
FIG. 5 is a cross sectional view taken along line 5-5 of FIG. 4 of an embodiment of the disclosure.
Figure 6:
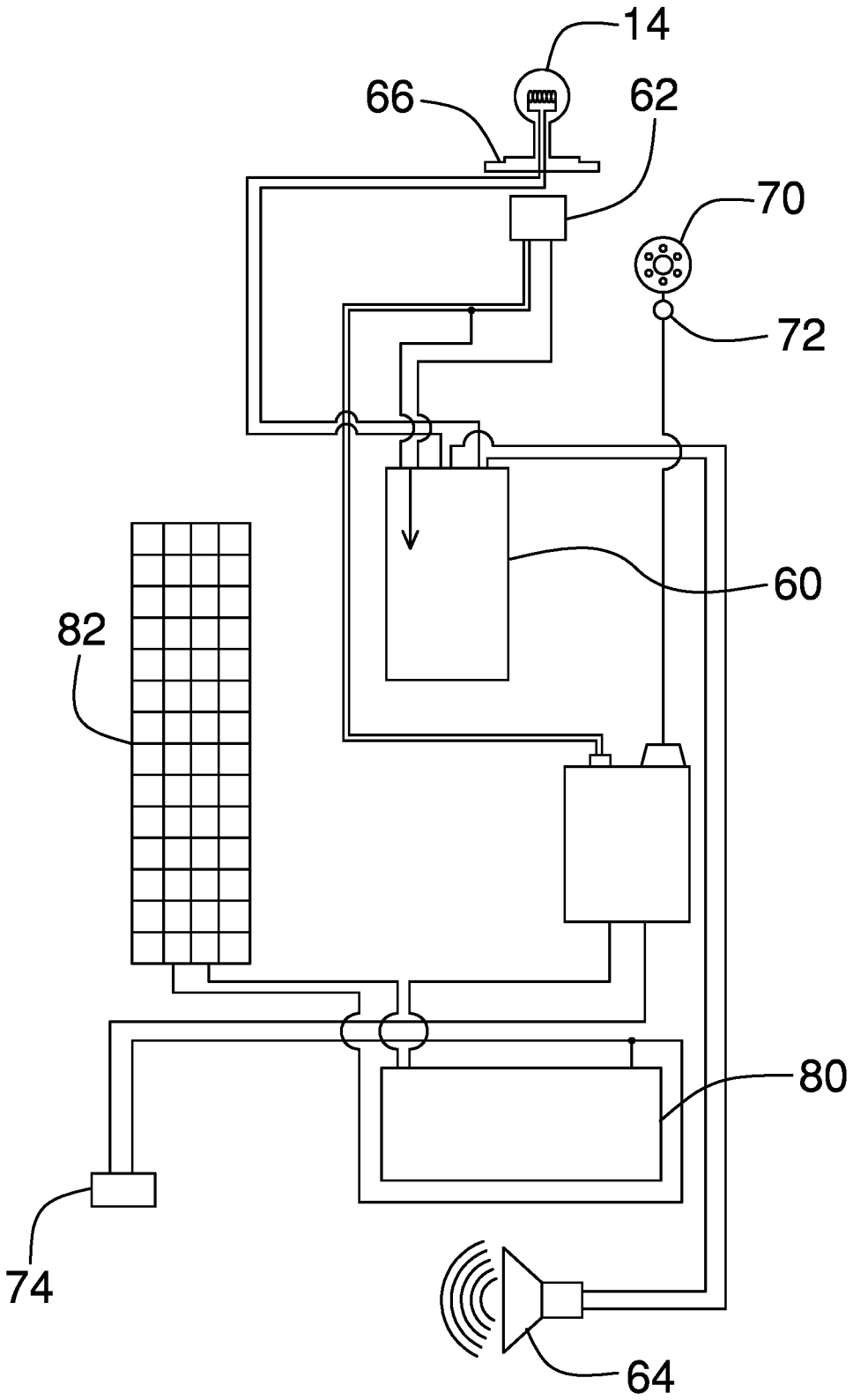
FIG. 6 is a schematic view of an embodiment of the disclosure.

With reference now to the drawings, and in particular to FIGS. 1 through 6 thereof, a new lighthouse device embodying the principles and concepts of an embodiment of the disclosure and generally designated by the reference numeral 10 will be described.

As best illustrated in FIGS. 1 through 6, the portable lighthouse assembly 10 generally comprises a lighthouse 12 that has a height of less than 4.0 feet. The lighthouse 12 has a light emitter 14 that is rotatably positioned thereon to emit light outwardly therefrom. Additionally, the lighthouse 12 is positionable in a yard of a residence of the like. Thus, the light emitter 14 can deter intruders when the light emitter 14 is turned on by startling the intruders. The intruders may be wild animals or people.

The lighthouse 12 comprises a lower disk 16 that has a bottom surface 18 and a top surface 20, and the bottom surface 18 is positioned on ground. A plurality of rollers 22 is each rotatably coupled to the bottom surface 18 of the lower disk 16 for rolling along the support surface. The lighthouse 12 includes a tower 24 that has a bottom end 26, a top end 28 and an outer wall 30 extending therebetween. The outer wall 30 has a plurality of intersecting sides 32 such that the tower 24 has an octagonal cross section taken along a line extending through the top 28 and bottom 26 ends. Additionally, the outer wall 30 tapers inwardly between the bottom 26 and top 28 ends, and the bottom end 26 is coupled to the top surface 20 of the lower disk 16.

A respective pair of the intersecting sides 32 has a recess 34 extending inwardly toward a center of the tower 24. The recess 34 extends from a point positioned adjacent to the top end 28 downwardly toward the bottom end 26. Additionally, the outer wall 30 has an opening 36 extending into an interior of the tower 24. A door 38 is hingedly coupled to the outer wall 30 of the tower 24 and the door 38 is aligned with the opening 36 for opening 36 and closing the opening 36. The door 38 comprises a pair of panels 40 each oriented an angle with respect to each other. In this way the door 38 conforms to the plurality of intersecting sides 32 of the outer wall 30 when the door 38 is closed.

A lock 42 is coupled to the door 38 and the lock 42 engages the outer wall 30 of the tower 24 when the door 38 is closed and the lock 42 is locked. In this way the lock 42 inhibits the door 38 from being opened. The lock 42 disengages the outer wall 30 when the lock 42 is unlocked thereby facilitating the door 38 to be opened and closed. The lighthouse 12 includes a top disk 44 that has a lower surface 46 and an upper surface 48. The top disk 44 has a diameter is less than a diameter of the lower disk 16, and the lower surface 46 has the top end 28 of the tower 24 is coupled thereto.

The lighthouse 12 includes a cylinder 50 that has a bottom end 49 and a top end 51, and the bottom end 49 of the cylinder 50 is coupled to the upper surface 48 of the top disk 44. The cylinder 50 is comprised of a translucent material to pass light therethrough. Moreover, the light emitter 14 is rotatably positioned within the cylinder 50 for emitting light outwardly through the cylinder 50. A pair of rods 52 is provided and each of the rods 52 has a lower end 54 and an upper end 56. The lower end 54 of each of the rods 52 is coupled to the upper surface 48 of the top disk 44 and each of the rods 52 is positioned on opposite sides of the cylinder 50 from each other. A cap 58 is positioned on the top end 51 of the cylinder 50 and the cap 58 has a diameter that is greater than a diameter of the cylinder 50. The upper end 56 of each of the rods 52 engages the cap 58 to retain the cap 58 on the cylinder 50.

A control circuit 60 is coupled to the lighthouse 12 and the control circuit 60 receives a motion input. The light emitter 14 is electrically coupled to the control circuit 60 and the light emitter 14 is turned on when the control circuit 60 receives the motion input. A motion sensor 62 is coupled to the lighthouse 12 to sense motion within a pre-determined perimeter of the lighthouse 12. The motion sensor 62 is electrically coupled to the control circuit 60 and the control circuit 60 receiving the motion input when the motion sensor 62 senses motion. In this way the light emitter 14 can be turned on to startle the source of motion. Additionally, the motion sensor 62 may be positioned on the outer wall 30 of the tower 24, and the motion sensor 62 may comprise an electronic motion sensor 62 of any conventional design.

An alarm 64 is coupled to the lighthouse 12 and the alarm 64 emits an audible alarm 64 outwardly therefrom. The alarm 64 is electrically coupled to the control circuit 60. Moreover, the alarm 64 is turned on when the control circuit 60 receives the motion input to startle the source of motion. The alarm 64 may comprise an electronic siren or the like.

A motor 66 is positioned within the cylinder 50 and the motor 66 is electrically coupled to the control circuit 60. The motor 66 is turned on when the control circuit 60 receives the motion input. The light emitter 14 is rotatably coupled to the motor 66 such that the motor 66 rotates the light emitter 14 when the motor 66 is turned on. A reflector 68 is positioned behind the light emitter 14 and the reflector 68 rotates with the light emitter 14. In this way the motor 66 produces a beam of light that rotates in the manner of a conventional lighthouse 12.

A camera 70 is coupled to the lighthouse 12 for capturing images or video of an environment proximate the lighthouse 12. The camera 70 is electrically coupled to the control circuit 60 and the camera 70 is turned on when the control circuit 60 receives the motion input. The camera 70 may be positioned on the outer wall 30 of the tower 24 and the camera 70 may comprise a digital video camera or the like. A microphone 72 is coupled to the lighthouse 12 to record audible sounds proximate the lighthouse 12. The microphone 72 is electrically coupled to the control circuit 60 and the microphone 72 is turned on when the control circuit 60 receives the motion input. The control circuit 60 may include an electronic memory for storing imagery recorded by the camera 70 and audio recorded by the microphone 72.

A switch 74 is coupled to the tower 24 and the switch 74 is electrically coupled to the control circuit 60 for turning the control circuit 60 on and off. A transceiver 76 may be included and the transceiver 76 may be electrically coupled to the switch 74. The transceiver 76 may be in wireless electrical communication with a remote control. Thus, the switch 74 may be remotely turned on and off. The transceiver 76 may be a radio frequency transceiver 76 or the like.

A power supply 78 is coupled to the tower 24 and the power supply 78 is electrically coupled to the switch 74. The power supply 78 comprises at least one battery 80 that is positioned within the housing. The at least one battery 80 is accessible through the opening 36 in the outer wall 30 of the tower 24 and the at least one battery 80 is electrically coupled to the switch 74. A solar panel 82 is coupled to the outer wall 30 of the tower 24 such that the solar panel 82 is exposed to sunlight. The solar panel 82 is positioned in the recess 34 having the solar panel 82 being coextensive with the recess 34. Additionally, the solar panel 82 is electrically coupled to the at least one battery 80 for charging the at least one battery 80. The power supply 78 may additionally include inverters and other electronic components involved with solar power circuitry.

In use, the lighthouse 12 is positioned in an area that needs to be patrolled for intruding animals or people. The control circuit 60 turns on the light emitter 14, the motor 66, the camera 70, the microphone 72 and the alarm 64 when the motion sensor 62 senses motion. Thus, the light emitter 14 and the alarm 64 startle the source of the motion, and the camera 70 and microphone 72 captures imagery and audio of the source of the motion. The control circuit 60 turns off the light emitter 14, the motor 66, the camera 70, the microphone 72 and the alarm 64 after a pre-determined amount of time has elapsed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable lighthouse assembly being configured to be turned on after sensing motion for deterring intruders, said assembly comprising:

a lighthouse having a height being less than 4.0 feet, said lighthouse having a light emitter being rotatably positioned thereon wherein said light emitter is configured to emit light outwardly therefrom, said lighthouse being positionable in a yard wherein said light emitter is configured to deter intruders when said light emitter is turned on;

a control circuit being coupled to said lighthouse, said control circuit receiving a motion input, said light emitter being electrically coupled to said control circuit, said light emitter being turned on when said control circuit receives said motion input wherein said light emitter is configured to startle a source of motion;

a motion sensor being coupled to said lighthouse wherein said motion sensor is configured to sense motion within a pre-determined perimeter of said lighthouse, said motion sensor being electrically coupled to said control circuit;

an alarm being coupled to said lighthouse wherein said alarm is configured to emit an audible alarm outwardly therefrom, said alarm being electrically coupled to said control circuit, said alarm being turned on when said control circuit receives said motion input wherein said alarm is configured to startle the source of motion;

a camera being coupled to said lighthouse wherein said camera is configured to capture images or video of an environment of said lighthouse, said camera being electrically coupled to said control circuit, said camera being turned on when said control circuit receives said motion input; and a microphone being coupled to said lighthouse wherein said microphone is configured to record audible sounds proximate said lighthouse, said microphone being electrically coupled to said control circuit, said microphone being turned on when said control circuit receives said motion input;

wherein said lighthouse comprises:

a lower disk having a bottom surface and a top surface, said bottom surface being positioned on ground;

a tower having a bottom end, a top end and an outer wall extending therebetween, said outer wall having a plurality of intersecting sides such that said tower has an octagonal cross section taken along a line extending through said top and bottom ends, said outer wall tapering inwardly between said bottom and top ends, said bottom end being coupled to said top surface of said lower disk; a respective pair of said intersecting sides has a recess extending inwardly toward a center of said tower, said recess extending from a point being positioned adjacent to said top end downwardly toward said bottom end, said outer wall having an opening extending into an interior of said tower; and said camera is positioned on said outer wall of said tower.

2. The assembly according to claim 1, wherein said lighthouse comprises:

a door being hingedly coupled to said outer wall of said tower, said door being aligned with said opening for opening and closing said opening, said door comprising a pair of panels each being oriented an angle with respect to each other, said door conforming to said plurality of intersecting sides of said outer wall when said door is closed; and a lock being coupled to said door, said lock engaging said outer wall of said tower when said door is closed and said lock is locked thereby inhibiting said door from being opened, said lock disengaging said outer wall when said lock is unlocked thereby facilitating said door to be opened and closed.

3. The assembly according to claim 1, wherein said lighthouse comprises:

a top disk having a lower surface and an upper surface, said top disk having a diameter being less than a diameter of said lower disk, said lower surface having said top end of said tower being coupled thereto;

a cylinder having a bottom end and a top end, said bottom end being coupled to said upper surface of said top disk, said cylinder being comprised of a translucent material wherein said cylinder is configured to pass light therethrough, said light emitter being rotatably positioned within said cylinder for emitting light outwardly through said cylinder;

a pair of rods, each of said rods having a lower end and an upper end, said lower end of each of said rods being coupled to said upper surface of said top side, each of said rods being positioned on opposite sides of said cylinder from each other; and a cap being positioned on said top end of said cylinder, said cap having a diameter being greater than a diameter of said cylinder, said upper end of each of said rods engaging said cap to retain said cap on said cylinder.

4. The assembly according to claim 3, further comprising a motor being positioned within said cylinder, said motor being electrically coupled to said control circuit, said motor being turned on when said control circuit receives said motion input, said light emitter being rotatably coupled to said motor such that said motor rotates said light emitter when said motor is turned on.

5. The assembly according to claim 1, wherein said control circuit receives said motion input when said motion sensor senses motion wherein said light emitter is configured to be turned on to startle the source of motion, said motion sensor being positioned on said outer wall of said tower.

6. The assembly according to claim 1, further comprising:

a switch being coupled to said tower, said switch being electrically coupled to said control circuit, said switch turning said control circuit on and off; and a power supply being coupled to said tower, said power supply being electrically coupled to said switch.

7. The assembly according to claim 6, wherein said power supply comprises:

at least one battery being positioned within said housing, said at least one battery being accessible through said opening in said outer wall of said tower, said at least one battery being electrically coupled to said switch; and a solar panel being coupled to said outer wall of said tower wherein said solar panel is configured to be exposed to sunlight, said solar panel being positioned in said recess having said solar panel being coextensive with said recess, said solar panel being electrically coupled to said at least one battery for charging said at least one battery.

8. A portable lighthouse assembly being configured to be turned on after sensing motion for deterring intruders, said assembly comprising:

a lighthouse having a height being less than 4.0 feet, said lighthouse having a light emitter being rotatably positioned thereon wherein said light emitter is configured to emit light outwardly therefrom, said lighthouse being positionable in a yard wherein said light emitter is configured to deter intruders when said light emitter is turned on, said lighthouse comprising:

a lower disk having a bottom surface and a top surface, said bottom surface being positioned on ground;

a plurality of rollers, each of said rollers being rotatably coupled to said bottom surface of said lower disk wherein each of said rollers is configured to roll along the support surface;

a tower having a bottom end, a top end and an outer wall extending therebetween, said outer wall having a plurality of intersecting sides such that said tower has an octagonal cross section taken along a line extending through said top and bottom ends, said outer wall tapering inwardly between said bottom and top ends, said bottom end being coupled to said top surface of said lower disk, a respective pair of said intersecting sides having a recess extending inwardly toward a center of said tower, said recess extending from a point being positioned adjacent to said top end downwardly toward said bottom end, said outer wall having an opening extending into an interior of said tower;

a door being hingedly coupled to said outer wall of said tower, said door being aligned with said opening for opening and closing said opening, said door comprising a pair of panels each being oriented an angle with respect to each other, said door conforming to said plurality of intersecting sides of said outer wall when said door is closed;

a lock being coupled to said door, said lock engaging said outer wall of said tower when said door is closed and said lock is locked thereby inhibiting said door from being opened, said lock disengaging said outer wall when said lock is unlocked thereby facilitating said door to be opened and closed;

a top disk having a lower surface and an upper surface, said top disk having a diameter being less than a diameter of said lower disk, said lower surface having said top end of said tower being coupled thereto;

a cylinder having a bottom end and a top end, said bottom end being coupled to said upper surface of said top disk, said cylinder being comprised of a translucent material wherein said cylinder is configured to pass light therethrough, said light emitter being rotatably positioned within said cylinder for emitting light outwardly through said cylinder;

a pair of rods, each of said rods having a lower end and an upper end, said lower end of each of said rods being coupled to said upper surface of said top side, each of said rods being positioned on opposite sides of said cylinder from each other;

a cap being positioned on said top end of said cylinder, said cap having a diameter being greater than a diameter of said cylinder, said upper end of each of said rods engaging said cap to retain said cap on said cylinder;

a control circuit being coupled to said lighthouse, said control circuit receiving a motion input, said light emitter being electrically coupled to said control circuit, said light emitter being turned on when said control circuit receives said motion input;

a motion sensor being coupled to said lighthouse wherein said motion sensor is configured to sense motion within a pre-determined perimeter of said lighthouse, said motion sensor being electrically coupled to said control circuit, said control circuit receiving said motion input when said motion sensor senses motion wherein said light emitter is configured to be turned on to startle the source of motion, said motion sensor being positioned on said outer wall of said tower;

an alarm being coupled to said lighthouse wherein said alarm is configured to emit an audible alarm outwardly therefrom, said alarm being electrically coupled to said control circuit, said alarm being turned on when said control circuit receives said motion input wherein said alarm is configured to startle the source of motion;

a motor being positioned within said cylinder, said motor being electrically coupled to said control circuit, said motor being turned on when said control circuit receives said motion input, said light emitter being rotatably coupled to said motor such that said motor rotates said light emitter when said motor is turned on;

a camera being coupled to said lighthouse wherein said camera is configured to capture images or video of an environment of said lighthouse, said camera being electrically coupled to said control circuit, said camera being turned on when said control circuit receives said motion input, said camera being positioned on said outer wall of said tower;

a microphone being coupled to said lighthouse wherein said microphone is configured to record audible sounds proximate said lighthouse, said microphone being electrically coupled to said control circuit, said microphone being turned on when said control circuit receives said motion input;

a switch being coupled to said tower, said switch being electrically coupled to said control circuit, said switch turning said control circuit on and off; and a power supply being coupled to said tower, said power supply being electrically coupled to said switch, said power supply comprising: at least one battery being positioned within said housing, said at least one battery being accessible through said opening in said outer wall of said tower, said at least one battery being electrically coupled to said switch;

a solar panel being coupled to said outer wall of said tower wherein said solar panel is configured to be exposed to sunlight, said solar panel being positioned in said recess having said solar panel being coextensive with said recess, said solar panel being electrically coupled to said at least one battery for charging said at least one battery.

* * * * *